US010617923B2

(12) United States Patent
Upshall et al.

(10) Patent No.: US 10,617,923 B2
(45) Date of Patent: Apr. 14, 2020

(54) FOLDABLE GOAL POST ASSEMBLY

(71) Applicant: MITRE SPORTS INTERNATIONAL LIMITED, London OT (GB)

(72) Inventors: Mark Upshall, London (GB); Christopher Woollett, London (GB)

(73) Assignee: MITRE SPORTS INTERNATIONAL LIMITED, London (GB)

( * ) Notice: Subject to any disclaimer, the term of this patent is extended or adjusted under 35 U.S.C. 154(b) by 0 days.

(21) Appl. No.: 14/931,663

(22) Filed: Nov. 3, 2015

(65) Prior Publication Data

US 2016/0325162 A1 Nov. 10, 2016

(30) Foreign Application Priority Data

Nov. 3, 2014 (GB) ..... 1419552.3

(51) Int. Cl.
*A63B 63/00* (2006.01)

(52) U.S. Cl.
CPC ..... *A63B 63/004* (2013.01); *A63B 2210/50* (2013.01)

(58) Field of Classification Search
CPC . A63B 63/004; A63B 2210/50; E04B 1/3441; Y10T 403/32254;

(Continued)

(56) References Cited

U.S. PATENT DOCUMENTS 4,145,044 A * 3/1979 Wilson ..... A63B 63/083 248/188.1
4,286,353 A * 9/1981 Roche ..... E04B 1/3441 16/341

(Continued)

FOREIGN PATENT DOCUMENTS

EP 2589418 A1 5/2013
GB 2297493 A 8/1996

(Continued)

OTHER PUBLICATIONS

Extended European Search Report for EP Application No. 15192576.5, dated Mar. 14, 2016, 7 pages.

(Continued)

*Primary Examiner* — Laura Davison

(74) *Attorney, Agent, or Firm* — Foster Garvey PC; P. G. Scott Born

(57) ABSTRACT

An elbow joint for a foldable goal post assembly, the elbow joint comprising a first elbow portion attachable to a first goal post and a second elbow portion attachable to a second goal post, the second elbow portion pivotally connectable to the first elbow portion about a hinged connection. The assembly also includes a locking rod. The first elbow portion defines a first cavity for receiving at least a portion of the locking rod and the second elbow portion defines a second cavity for receiving at least a portion of the locking rod. The elbow connector is configured such that the locking rod is slidably movable between a first configuration in which the locking rod is partially located within the first cavity and partially located within the second cavity to lock the elbow joint by preventing pivotal movement of the first and second elbow portions about the hinged connection and a second configuration in which the locking rod is pulled out of at least one of the cavities to unlock the elbow joint such that the first and second elbow portions are permitted to pivot about the hinged connection.

13 Claims, 9 Drawing Sheets

(58) Field of Classification Search
CPC ..... Y10T 403/32262; Y10T 403/32319; Y10T 403/32327; Y10T 403/32344; Y10T 403/32442; Y10T 403/32459; Y10T 403/32286
USPC ..... 473/478; 403/84, 92
See application file for complete search history.

(56) References Cited

U.S. PATENT DOCUMENTS 4,407,045 A 10/1983 Boothe
4,929,113 A * 5/1990 Sheu ..... F16C 11/045 403/157
5,265,969 A * 11/1993 Chuang ..... A45B 17/00 16/329
5,620,272 A 4/1997 Sheng
5,681,045 A * 10/1997 Liao ..... A63B 63/004 273/400
5,954,600 A 9/1999 Gill
6,397,433 B1 * 6/2002 Chen ..... E04H 15/48 16/324
6,979,274 B1 * 12/2005 Raber ..... A63B 63/004 473/471
8,216,092 B2 7/2012 Wennesland
9,120,001 B2 * 9/2015 Huang ..... A63B 63/004
9,180,353 B2 * 11/2015 Chen ..... A63B 63/004
2002/0064417 A1 5/2002 Feng
2003/0153412 A1 * 8/2003 Duba ..... A63B 63/004 473/478
2003/0181267 A1 * 9/2003 Lee ..... A63B 63/004 473/478
2004/0116215 A1 * 6/2004 Fobean ..... A63B 63/004 473/478
2004/0219999 A1 * 11/2004 Oister ..... A63B 63/004 473/478
2011/0158815 A1 * 6/2011 Mandali ..... F01D 5/3046 416/222
2012/0063839 A1 3/2012 Mo
2012/0100940 A1 * 4/2012 Hajarian ..... A63B 63/004 473/476
2012/0184399 A1 * 7/2012 Reeves ..... F16B 7/042 473/478
2013/0312799 A1 * 11/2013 Hotes ..... E04H 15/48 135/93
2014/0155197 A1 6/2014 Goldwitz

FOREIGN PATENT DOCUMENTS

WO 2011053163 A1 5/2011
WO WO 2011053163 A1 * 5/2011 ..... A63B 63/004

OTHER PUBLICATIONS

Search Report for GB Application No. 1419552.3 dated Apr. 29, 2015, 8 pages.

* cited by examiner

FOLDABLE GOAL POST ASSEMBLY

PRIORITY CLAM

This non-provisional application claims priority under 35 U.S.C. § 119(a) to Patent Application No. 1419552.3 filed in Great Britain on Nov. 3, 2014, the entire contents of which is hereby incorporated by reference as if fully set forth herein.

FIELD OF THE INVENTION

The present invention relates to an elbow joint for a foldable goal post assembly. The invention also relates to foldable goal post assemblies comprising one or more of the foldable connectors.

BACKGROUND OF THE INVENTION

Many sports such as soccer and hockey involve the presence of goal equipment, usually in the form of netting mounted on a support frame, the support frame including vertical goalposts which form side bars and a horizontal post mounted to the vertical goalposts to form a cross bar. Goal assemblies are large and bulk so are often fixed in place on a sports field. However, collapsible goal assemblies which allow the goals to be folded down to a reduced size are known. Such assemblies provide for ease of removal from the field and transport between locations. This is particularly desirable in the case of playing sports casually or recreationally, including children's sports, which are often played in areas not already equipped with fixed goal equipment.

US 2012/0100940 A1 describes a foldable and adjustable sport goal; US 2004/0116215 A1 describes a children's collapsible sports goal for soccer or hockey. The upright portion of the goal is pivotally connected to the base and parallel legs of the upright portion are releasably secured to a cross member of the upright portion; US 2012/0184399 A1 describes a collapsible structure which can be used as a sporting goal for soccer. The assembly includes joints which are collapsible by disconnection, a flexible connector which passes between parts of the joint allowing the assembly to collapse; WO2011/053163 A1 describes a mini collapsible goal for soccer and football training in which the cross bar and side bar are connected by hinge elements allowing the structure to collapse. The hinge elements described include an internal coiled spring resiliently connecting the vertical bar and horizontal bar to each other; and U.S. Pat. No. 6,979,274 B1 describes a portable goal assembly that folds in two dimensions. The cross bar and side bars are connected by releasably lockable hinges which consist of a threaded connection between the cross bar and side bar.

Existing foldable goal-post assemblies such as those discussed above are complex constructions which can be difficult to assemble and disassemble, especially for a single child or group of children without the assistance of an adult. Furthermore, many of the folding mechanisms proposed for foldable goal-post assemblies lack the strength and durability required to be able to withstand repeated impact of a soccer ball, hockey puck etc. against the goal structure.

BRIEF DESCRIPTION OF THE DRAWINGS

Preferred and alternative examples of the present invention are described in detail below with reference to the following drawings.

DETAILED DESCRIPTION OF TUE PREFERRED EMBODIMENT

Figure 1:
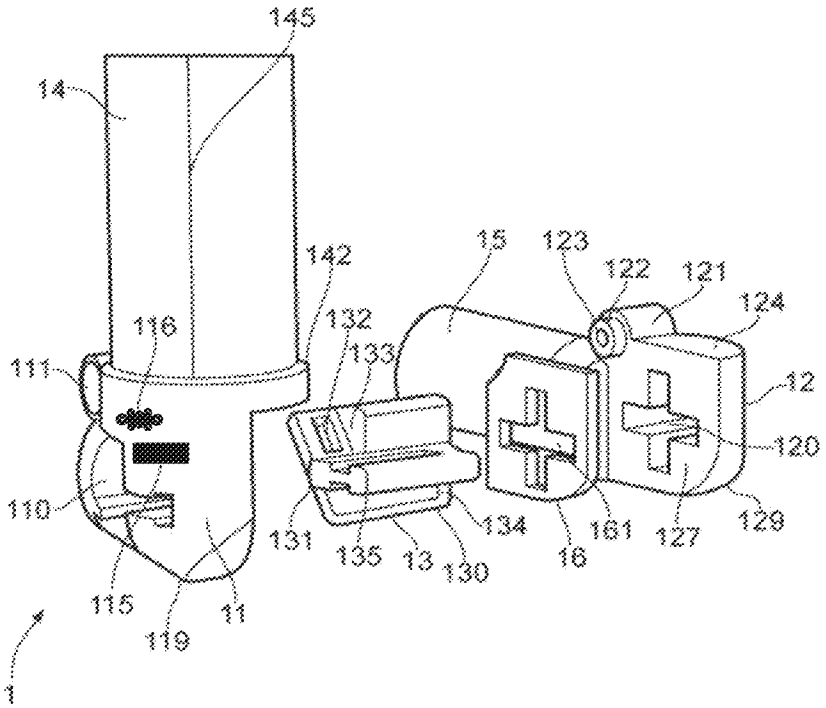
FIG. 1: shows an exploded perspective view of an elbow joint according to one embodiment of the present invention.
Figure 2:
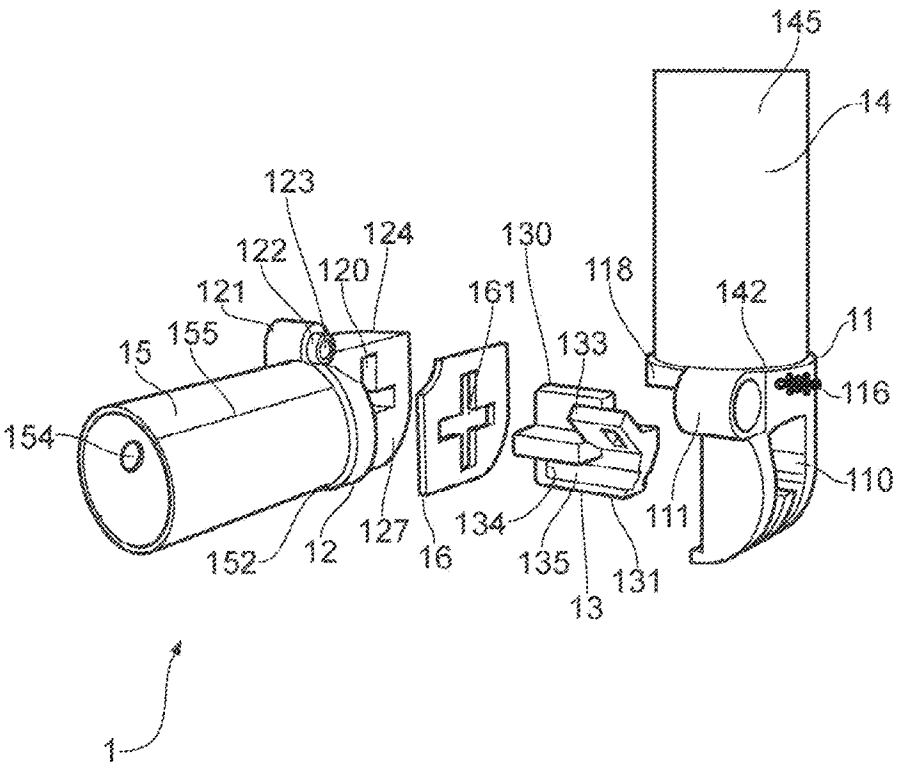
FIG. 2: shows an alternative exploded perspective view of the elbow joint of FIG. 1.
Figure 3:
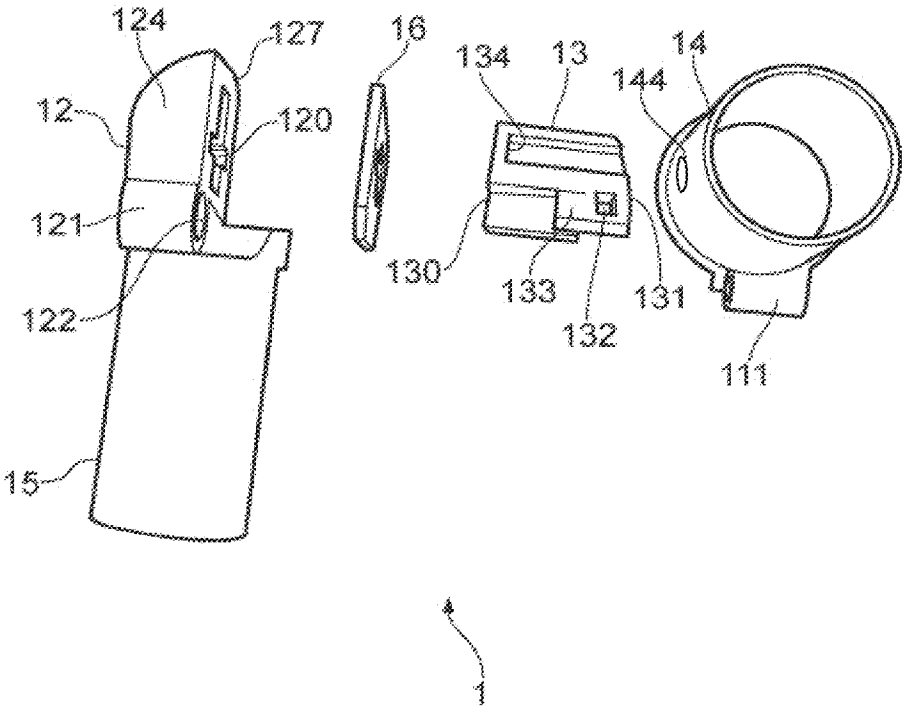
FIG. 3: shows an alternative exploded perspective view of the elbow joint of FIG. 1 and FIG. 2.
Figure 4:
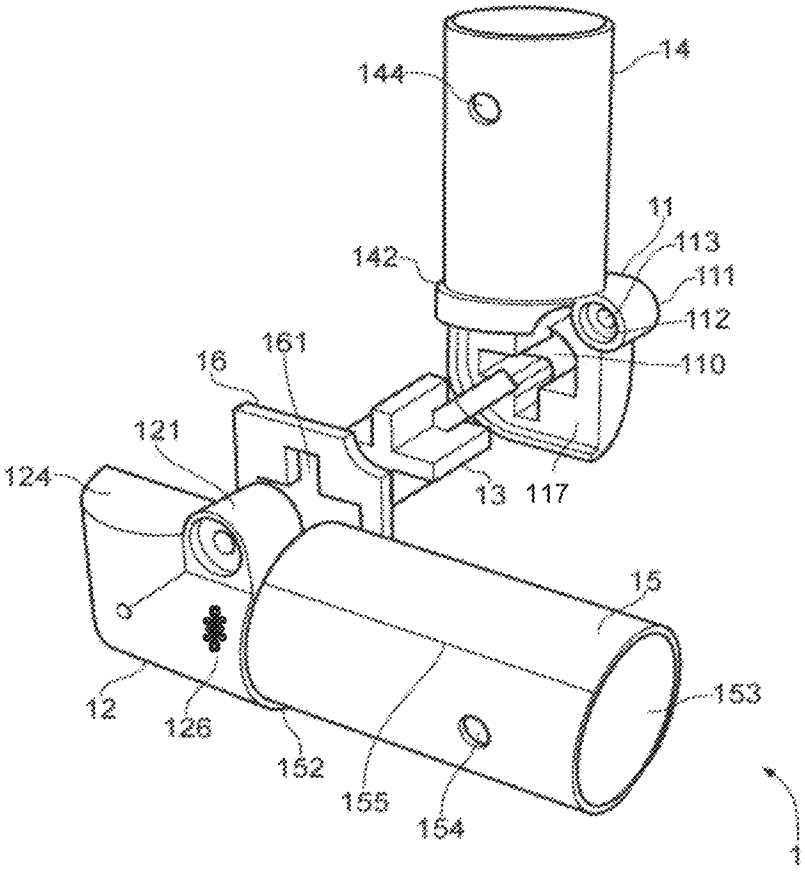
FIG. 4: shows an alternative exploded perspective view of the elbow joint of FIG. 1 to FIG. 3.
Figure 5:
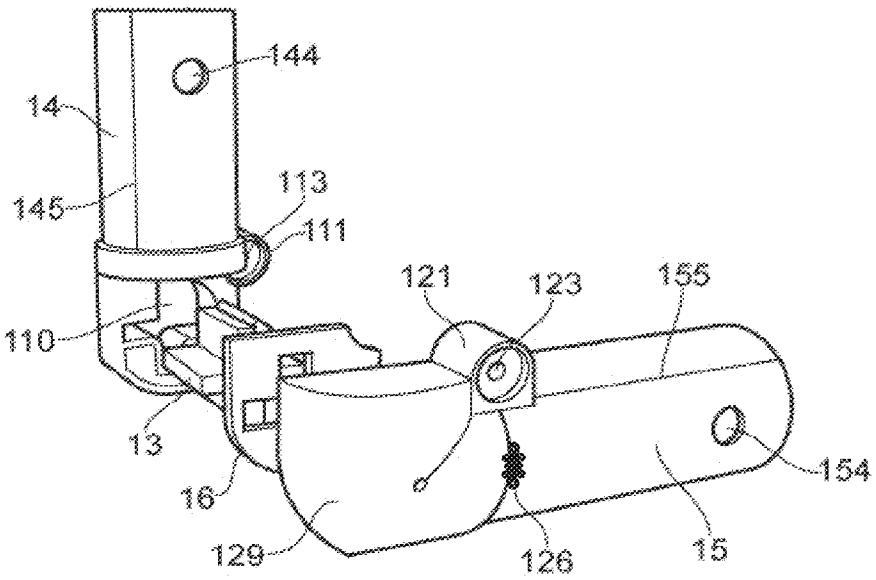
FIG. 5: shows an alternative exploded perspective view of the elbow joint of FIG. 1 to FIG. 4.

Accordingly, the present invention aims to solve the above problems by providing, according to a first aspect, an elbow joint for a foldable goal post assembly, the elbow joint comprising: a first elbow portion attachable to a first goal post a second elbow portion attachable to a second goal post, the second elbow portion pivotally connectable to the first elbow portion about a hinged connection; and a locking rod; wherein the first elbow portion defines a first cavity for receiving at least a portion of the locking rod and wherein the second elbow portion defines a second cavity for receiving at least a portion of the locking rod; and wherein the elbow connector is configured such that the locking rod is slidably movable between: a first configuration in which the locking rod is partially located within the first cavity and partially located within the second cavity to lock the elbow joint by preventing pivotal movement of the first and second elbow portions about the hinged connection; and a second configuration in which the locking rod is pulled out of at least one of the cavities to unlock the elbow joint such that the first and second elbow portions are permitted to pivot about the hinged connection.

In this way, a goal assembly comprising the elbow joints of the present inventions as foldable connectors between goal posts can be easily transitioned between a collapsed/folded configuration and an assembled/unfolded configuration in which it is ready for use in a sports game. In particular, the simple act of pulling out the locking rod to release the hinge results in an easy mechanism to operate.

The elbow joint is therefore very easy to use as a single movement of the locking rod between the first and second configurations being required to fold and unfold the elbow joint (and the foldable goal-post assembly, when connected to the elbow joint). Furthermore, the locking rod provides a very robust and secure locking mechanism within the elbow joint while not detracting in any way from the ease of foldability of the joint. In particular the fact that the locking rod is located within the first and second elbow portions when in a locked configuration means that the elbow joint imparts strength and durability to the foldable goal-post assembly when in the assembled configuration so that it can withstand the repeated impact of use and therefore enjoy an extended lifetime without the need for frequent replacement of parts.

It should be understood that the locking rod has a longitudinal axis and preferably slides along the direction of this axis between the first configuration and the second configuration. The transverse cross-section is the cross section of the locking rod along a direction at right angles to its longitudinal axis.

Optional features of the invention will now be set out. These are applicable singly or in any combination with any aspect of the invention.

Optionally, in the first configuration the locking rod is fully located within the first and second cavities such that it does not externally protrude from the elbow joint.

In this way, when the elbow joint is in the locked configuration, the locking rod is fully located within the first and second cavities and does not externally protrude from the elbow joint. In sports such as soccer and hockey there is a risk that a player may accidentally come into contact with the goal-post assembly, and where a goal-post includes exposed projections this could cause harm to the player.

Ensuring that the locking rod does not externally protrude means that the elbow joint carries no more risk than standard non-foldable elbow joints used in fixed goal post assemblies. Furthermore, ensuring that no part of the locking rod is exposed outside the elbow joint reduces the risk of unintentional movement of the locking rod from the first configuration to the second configuration during use and therefore avoids unintentional collapse of a foldable goal-post assembly which incorporates the elbow joint.

Optionally, the transverse cross-section of the locking rod is cross-shaped along at least a portion of the longitudinal length of the locking rod.

The provision of a cross-shaped transverse cross-section of the locking, rod increases the resistance of the locking rod to the shearing forces imparted by the first and second elbow portions when an attempt is made to move the elbow portions from the first configuration to the second configuration when the locking rod is partially located within the first cavity and partially located within the second cavity. This cross-sectional shape therefore imparts strength to the elbow joint, ensuring that any foldable goal-post assembly which incorporates the elbow joint can withstand impact from e.g. a ball or a player, and could even withstand the force of e.g. the weight of a person suspended from the cross-bar of the assembly. This advantage is not provided by a locking rod with a simple shaped cross-section, such as circular or square cross-sectional rods.

Optionally, in the first configuration, the portion of the longitudinal length of the locking rod which is cross-shaped in transverse cross-section is partially located within the first cavity and partially located within the second cavity.

The advantage provided by the cross-shaped transverse cross-section is increased when, in the first configuration, the longitudinal section of the locking rod having such a cross section resides within both the first and second cavities of the elbow joint.

Optionally, the locking rod includes a terminal portion of longitudinal length having transverse cross-section which is different from that of the cross-shaped cross section of the remainder of the longitudinal length of the locking rod.

Where a terminal portion of the locking rod has a transverse cross-section which is different from the cross-shaped cross section of the rest of the locking rod, clearance is provided within the cavity adjacent to the terminal portion of the locking rod which allows the user access to the locking rod for ease of movement between the first and second configurations. In other words, when the locking rod is viewed down its longitudinal axis with the terminal portion closest to the viewer, the cross-section of the terminal portion does not fully obscure the view of the cross-shaped cross-sectional portion of the locking rod.

Optionally, the terminal portion of longitudinal length has a Y-shaped transverse cross-section.

Access to the locking rod in this case may therefore be provided by an opening which provides access for a user's hand so that they can grip the "stem" of the Y-shaped transverse cross-section of the terminal portion of the locking rod to pull the locking rod from the first configuration to the second configuration.

In some embodiments, a locking mechanism is provided to secure the locking rod in the first configuration.

Optionally, the hinged connection is off-axis.

An "Off-axis" location of the hinged connection corresponds to an axis which, when the elbow joint is in use, does not intersect the primary longitudinal axis of either the first or second goal-posts connected to the elbow joint when in the first configuration. Instead, the hinged axis is off set from the center of the elbow joint. This provides an elbow joint in which the first and second elbow portions can pivot about the hinged connection until the primary longitudinal axes of the first and second goal-posts lie parallel, which would not be possible where the pivot lies along either axis.

An outer surface of the elbow joint may be cut away to form an opening to the first and/or second cavity which provides access for the locking rod.

Optionally, the locking rod includes a first abutment surface which abuts a projection from an inner wall of the second cavity in the second configuration, to prevent complete removal of the locking rod from the second cavity.

Where the locking rod includes a first abutment surface and the inner wall of the second cavity includes a complementary projection aligned with the first abutment surface along the sliding path of the locking rod, the locking rod may reach a position in which the first abutment surface and the projection are in contact, and further travel of the locking rod in the direction of the second cavity is prevented. Therefore, when moving from the first configuration into the second configuration, the locking rod will leave the first cavity, but reach a terminal position within the second cavity. The locking rod therefore cannot be fully removed from the elbow joint when in the second configuration.

This is advantageous because the elbow joint (and any foldable goal-post assembly in which it is incorporated) may be folded without the risk of loss of the locking rod during its removal from one of the cavities. The locking rod may therefore be an integral but moveable part of the elbow joint.

Optionally, the elbow joint includes an insert which lies between the first and second elbow portions in the second configuration, and the locking rod includes a projection which, in the first configuration, abuts a portion of the insert to prevent further passage of the locking rod into the first cavity.

The provision of a separate insert, which is insertable between the first and second elbow portions allows for easy assembly and disassembly of the elbow joint and complete removal of the locking rod where necessary, but controls the range of movement of the locking rod when assembled within the elbow joint. The projection on the locking rod will come into contact with a portion of the insert as the locking rod is moved from the second configuration into the first configuration, and further movement of the locking rod in that direction is thereby prevented. As a result, there is no chance of the locking rod passing so far in to the first cavity that it is fully removed from the second cavity, and the locked configuration is maintained.

When this arrangement is used in conjunction with the above arrangement of a first abutment surface on the locking rod and a projection from an inner wall of the second cavity, the effect is to provide slidable movement of the locking rod between a first terminal position and a second terminal position. In the first terminal position, the locking rod is partially located within the first cavity and partially located within the second cavity and further passage of the locking rod into the first cavity is prevented by the presence of the insert. When the locking rod is then moved into the second configuration (in this case, being pulled out of the first cavity), it reaches the second terminal position due to abutment between the first abutment surface on the locking rod and the projection from the inner wall of the second cavity, and complete removal of the locking rod from the second cavity is prevented.

Optionally, the first elbow portion comprises a first stop surface, and the second elbow portion comprises a second stop surface, the first and second stop surfaces being in contact with one another at a terminal position in the pivotal movement of the first and second elbow portions such that pivotal movement beyond the terminal position is prevented.

When such stop surfaces are provided on the first and second elbow portions the limit of the pivotal movement of the portions may be restricted. This offers further strength and support to the elbow joint and any foldable goal-post assembly comprising it when in the unfolded or assembled condition.

Preferably, the first and second stop surf come in to contact with one another when the primary longitudinal axes of the first and second goal posts lie at a 90° angle to one another. 90° is the standard angle defined between the first and second goal-posts when the first goal-post is a side post and the second goal-post is a cross-bar. It is to be understood that 90° is an ideal value and acceptable goal post assemblies and elbow joints may be provided where this angle lies within a range, for example, between 80° and 100°.

Optionally, at the terminal position, the elongate axes of the first and second elbow portions are perpendicular.

A perpendicular disposition between the first and second elbow portions (and therefore the first and second goal-posts when fitted to a goal-post assembly) is preferred in order provide a standard goal post configuration.

Optionally, the locking rod includes a hole for receiving a strap.

Where the locking rod includes a hole, a strap may be passed through the hole to aid the movement of the locking rod between the first and second configurations, in particular, to aid the movement of the locking rod from the first configuration into the second configuration. As described above, movement from the first configuration into the second configuration requires the locking rod to be pulled out of at least one of the cavities and the presence of a strap would mike this much easier.

Optionally, the first elbow portion comprises a first planar surface, and the second elbow portion comprises a second planar surface, the first and second planar surfaces each lying in planes perpendicular to the pivot axis of the hinged connection; and lying against one another in the second configuration.

This arrangement of planar surfaces which lie against one another in the second configuration provides a convenient way for the first and second cavities to be aligned in the second configuration to allow for the passage of the locking rod between them. When the first and second planar surfaces lie in planes perpendicular to the pivot axis of the hinged connection, they can easily slide across one another as the first and second elbow portions pivot about the hinged connection.

According to a second aspect, there is provided a foldable goal-post assembly including a first goal post having a first end; a second goal post, adjacent the first post, having a first end; and an elbow joint according to the first aspect, the elbow joint connecting the first and second posts at their respective first ends.

A foldable goal post assembly which incorporates an elbow joint according to the first aspect as described above includes all the advantages described with respect to the first aspect which are imparted to the goal-post assembly as a whole. The goal-post assembly is very easy to transition between unfolded and folded configurations by pivoting the first and second elbow portions of the elbow joint about the hinged connection when the locking rod is in the second configuration. Thus, a single movement of the locking rod is all that is necessary to be able to fold the first and second goal posts against one another. Furthermore, as described above, the structure of the locking rod and locking mechanism containing it provide the goal assembly with strength and durability when in the unfolded configuration.

Optionally, the first and second goal posts are fixedly attached to the first and second elbow portions respectively.

When the first and second goal-posts are fixedly attached to the elbow joint, the whole goal post assembly can still be folded about the elbow joint in a convenient manner. Alternatively, the first and/or second goal-posts may be removeably attachable to the elbow joint. This would allow for complete disassembly of the foldable goal-post assembly where necessary, for example when replacement of a goal post and/or replacement of the elbow joint is necessary, without requiring the entire assembly to be replaced.

Optionally, the first goal post is a side bar running along the ground and the second goal post is the vertical upright post. This provides a hinged connection between side bar and the goal post assembly.

The foldable goal-post assembly may further comprise: a base attached to a second end of the first goal post, a strut connectable at a first end to the first goal post and at a second end to the base; and a net, attached to at least the first goal post and the second goal post and comprising attachment means for attaching the net to the strut from beneath the strut.

It is desired for the foldable goal-post assembly of the second aspect to be easily foldable without the need to disassemble the goal posts, i.e. while leaving the posts and elbow joint connected. In standard portable goal-post assemblies, a diagonal support or strut passes between a side post and a base, to add further support to the structure and allow correct positioning of a net. A net is attached to each side post and the cross-bar, and is passed over the top of the diagonal struts around the back of the goal area.

For the foldable goal-post assembly according to the second aspect, this would be unsatisfactory because the diagonal struts need to be removed prior to folding and this would require the user to go into the net area underneath the strut in order to detach it from the assembly. Therefore, the second aspect provides a foldable goal-post assembly where the net may be suspended beneath each diagonal strut, being attached to each strut by attachment means. As a result, it is simple to remove only the struts from the assembly while leaving the net fully attached to the cross-bar and side posts. Disassembly is simplified by this arrangement.

Optionally, the attachment means comprises at least one loop of material attached to the net and reversibly attachable to the strut.

Such attachment means are very easy to t se and attachment to the net ensures that they do not become lost e.g. during transit.

The first and second elbow portions ma be made from any suitably robust material, such as any suitably rigid plastics material. This may be, for example, polypropylene copolymer such as Polypropylene Impact Copolymer, suitable melt values of which may be melt 12 or melt 15. Advantageously, such materials will have high impact strength at low temperatures.

The hinged connection between the first and second elbow portions may comprise any suitable hinge which allows the elbow portions to pivot about one another. For example, the hinged connection may comprise aligned bore holes in the first and second elbow portions through which fixing means such as a bolt may pass to provide a pivot point.

The locking rod may be made of the same material as the first and second elbow portions.

The transverse cross-section of the locking rod is not particularly limited to any particular shape, but as explained above a cross-shaped transverse cross-section along at least a portion of the length of the locking rod has been found to perform welt. Alternatively, the transverse cross-section may be any shape could be used that allows locking at the appropriate/desired angle.

The locking rod is preferably of a length which allows it to pass into both first and second cavities in the first configuration while preventing any part: of the locking rod protruding from the elbow joint in the first configuration.

The first cavity may pass through the entire width of the first elbow portion, i.e. the first cavity may be a bore through the entire width of the first elbow portion. Alternatively, the first cavity may be a recess which ends within the first elbow portion. The second cavity may pass through the entire width of the first elbow portion, i.e. the second cavity may be a bore. Alternatively, the second cavity may be a recess which ends within the first elbow portion. However, in any case it must be possible for the user to pull the locking rod from the first configuration into the second configuration.

The transverse cross sectional shape of the first and/or second cavity may substantially conform to the transverse cross-section of the locking rod. In this way, the locking rod may be a "tight fit"/friction fit within the first and/or second cavity. This ensures that the pivotal movement of the first and second elbow portions is properly restricted when the locking rod is in the first configuration. This also ensures that when the terminal positions) in the longitudinal movement of the locking rod are provided by the presence of the first abutment surface and projections on from the locking rod or cavity, the locking rod cannot move within the cavity to avoid the abutment at the terminal position(s).

Each elbow portion may include attachment means for the removable attachment of a standard goal-post. "Standard goal-post" means any goal post which is of a suitable shape and size to be used in a foldable goal-post assembly. Such goal-posts are already well known in the art and are commonly used with non-folding elbow joints. As an example, the goal posts may have a diameter of 63 mm.

The goal-post attachment means may comprise an outwardly extending arm which can be removably connected to a goal-post. The arm may be a hollow arm. The transverse cross-section of the arm may be chosen to match the transverse cross-section of the goal-post to be attached. Goal-posts are commonly cylindrical, so the arm may be cylindrical. The arm may be a hollow cylindrical arm. The outside diameter of the arm may be chosen to provide a friction-fit of the arm into the goal-post. Alternatively or additionally, protrusions or ridges may be provided on a portion of the outer surface of the arm to provide a more secure friction-fit of the arm into the goal-post.

The arm may further comprise securing means for securing the arm to the goal-post. The securing means may be an aperture, alignable with a complementary aperture in the goal-post such that fixing means may be passed between them to secure the arm and goal-post relative to one another. This will supplement the direct attachment of the arm to the goal-post.

Each elbow portion may provide a ridge or flange which abuts a terminal planar surface of the goal-post when the goal-post is attached to the elbow joint. Where the goal-post is cylindrical, this flange may be an annular flange. The height of the flange may be chosen to provide a smooth transition between the outer surface of the goal-post and the outer surface of the elbow joint when the goal-post is attached to the elbow joint, i.e. the height of the flange may be equal to the thickness of the goal-post cylinder.

The surface of the first and/or second elbow portion may include indicia beside the first and/or second cavity to provide an indication of the locking rod movement necessary to lock the elbow joint. The indicia may be one or more pointers or arrows.

The elbow joint may form a joint which locks in a right angle shape (to produce a right angle between a first goal post connected to the first elbow portion and a second goal post connected to the second elbow portion). However, it is also envisages that the elbow portion could be configured to lock two goalposts at other angles for example at an acute angle, an obtuse angle or at 180 degrees to one another.

The elbow joint according to the first aspect may be produced by any suitable manufacturing process, such as injection moulding or rotational moulding.

The locking rod preferably has a width in the transverse direction which is more than or equal to 30 mm. The transverse direction may be an direction perpendicular to its longitudinal axis, the longitudinal axis corresponding to the axis along which the locking rod is slidably movable between the first and second configurations.

Where the transverse cross section of the locking rod is cross shaped, it may comprise four equally spaced arms. The maximum width of the cross shaped rod will therefore be the distance from the tip of one arm to the tip of the opposite arm. This maximum width may be no less than 30 mm and may be no more than 60 mm, it may fir example be 46 mm. Each arm of the cross-shaped locking rod may have a thickness which is no less than 5 mm and no more than 25 mm. It may, for example be 10.5 mm.

The length of the locking rod along its longitudinal axis may be no less than 40 mm and may be no more than 65 mm. The thickness may, for example be 56.5 mm.

The first and second elbow portions of the elbow joint may further comprise an internal strengthening structure.

The internal strengthening structure may comprise a plurality of strengthening ribs.

The addition of strengthening ribs on the internal structure of the joint help prevent hyperextension of the joint and reduce the likeliness of sprain damage to the component.

Further optional features of the invention are set out below.

Any sub-titles herein are included for convenience only, and are not to be construed as limiting the disclosure in any way.

The invention will now be further described with reference to the following non-limiting Figures and Examples.

The disclosure of all references cited herein, inasmuch as it may be used by those skilled in the art to carry out the invention, is hereby specifically incorporated herein by cross-reference.

FIGS. 1-5 show an elbow joint according to one embodiment of the present invention, in an exploded configuration, from five different respective viewing angles.

The elbow joint 1 includes a first elbow portion 12 and a second elbow portion 11, which are connectable via a hinged connection made up of a first hinge portion 121 which is an integral part of the first elbow portion 12, and a second hinge portion 111 which is an integral part of the second elbow portion 11. Each elbow portion includes a corner portion 129, 119 and a cylindrical arm 15, 14 which may be a hollow cylindrical arm. The hollow cylindrical arms 15, 14 may be open at both ends, for example so that any objects or mud that gets into the arm can fall out or easily be pushed out.

First hinge portion 121 defines a first bore 123 which is alignable with a second bore 113 defined by second hinge portion 111. Attachment means (not shown) such as a bolt or screw may be passed through the first bore 123 and the second bore 113 to attach the first and second elbow portions together and provide a hinged connection between them. A raised annulus 122 extends from a first planar surface of the first elbow portion 12 and is sized to fit into a complementary recess 112 in the hinge portion 111 of the second elbow portion 11, to add further stability to the hinged connection between the two elbow portions.

Each elbow portion 12, 11 includes a first cylindrical arm 15, 14 extending away from the corner portion 129, 119. The outside diameter of the cylindrical arm 15, 14 is less than or equal to the inside diameter of a standard goal-post (not shown). Where the outside diameter of the arm 15, 14 is less than the inside diameter of a standard goal-post, raised ridges 155, 145 which extend in a longitudinal direction along the outside surface of the arm 15, 14 may allow a tight frictional fit to be achieved between an inside cylindrical surface of a hollow goal-post and the outside cylindrical surface of the arm 15, 14. Each corner portion 129, 119 defines an annular flange 152, 142 at the base of the arm 15, 14 which acts as an abutment surface against which the annular end-surface of a goal-post can be pushed. Therefore, when a goal post is attached, the outer surface of the goal post lies flush against the collar of the corner portion of each elbow portion 12, 11.

Each arm 15, 14 includes an aperture 154, 144 which allows for the passage of fixing means between the first arm 15, 14 and the corresponding aperture in a first goal post (not shown).

The corner portion 129 of the first elbow portion 12 defines a first cavity 120 which has a cross-shaped transverse cross-section. A corresponding second cavity 110 is defined by the corner portion 119 of the second elbow portion 11. The cross section of the second cavity 110 relative to the first cavity 120 is enlarged to include an extra cavity area between two adjacent "arms" of the cross. The remaining two intact "arms" of the second cavity 110 include multiple elongate projections on the inner surfaces, projecting into the cavity.

An insert 16 which defines a cross-shaped channel 161 which corresponds with the shape and size of the second cavity 110, acts as an interface between the first planar surface 127 and the second planar surface 117. The insert 16 is shaped to form a friction fit into the slightly recessed second planar surface 117.

When the elbow joint is fully assembled, a locking rod 13 is slidably moveable within a channel formed by the first cavity 120, the channel 161, and the second cavity 110. A first portion 130 of the locking rod has a substantially cross-shaped transverse cross-section. A second portion 131 of the locking rod 13 has a substantially Y-shaped transverse cross-section. The "stem" of the "Y" lies within the extra cavity area of the second cavity (between two adjacent "arms" of the cross-shaped portion of the locking rod 13), when viewed down the longitudinal axis of the locking rod. Therefore, this "stem" forms a projection from the locking rod which abuts against the insert 16 as the locking rod is moved along a channel into the first cavity 120.

Each "arm" of the Y-shaped portion of the locking rod 13 defines grooves 135 which end at a first abutment surface 134. The grooves 135 are each complimentary with one of the projections from the inner surface of second cavity 110. Therefore, as the locking rod slides along the channel from the first cavity 120 into the second cavity 110, the projections from the inner surface of the second cavity 110 will slide within grooves 135 on the surface of the locking rod 13 until they reach the first abutment surface 134 at which point no further travel of the locking rod 13 within the channel is possible.

When the elbow joint is assembled, the locking rod is therefore slidable between two terminal positions, the first terminal position being defined by the point at which projection 133 and insert 16 come in to contact and the second terminal position being defined by the point at which first abutment surface 134 and projections from the inner wall of the second cavity 110 come in to contact. At the first terminal position, the locking rod is in a first configuration in which the first portion 130 lies within a cavity defined by the first cavity 120 and the channel 16 of the insert 16. The second portion 131 of the locking rod 13 lies within the second cavity 110. As a result, it is not possible for the first and second elbow portions 12, 11 to pivot about the hinged connection 121, 111 and the elbow joint is fixed in an unfolded configuration. In this unfolded configuration, the primary longitudinal axes of the arms 14 and 15 are perpendicular.

At the second terminal position, locking rod 13 is in a second configuration wherein the locking rod is pulled out of the first cavity 120 entirely, so that first and second elbow portions may pivot about the hinged connection. The elbow portions may be pivoted so that arms 14, 15 approach one another and the primary longitudinal axes of arms 14, 15 are parallel.

First elbow portion 12 also includes a first stop surface 124, and the second elbow portion 11 includes a corresponding second stop surface 118. When the locking rod 13 is in the second configuration and the first and second elbow portions are pivoted from a folded position (where the primary longitudinal axes of arms 14 and 15 are parallel) into an unfolded position (in which the primary longitudinal axes of arms 14 and 15 are perpendicular), stop surfaces 118 and 124 meet one another and prevent further pivot of the elbow portions beyond the unfolded position. This increases the stability of the elbow joint when in use as a hinged connector between first and second goal-posts in a foldable goal post assembly.

A brand logo 116 is embossed on to the second elbow portion 11 and a similar brand logo 126 is engraved into the first elbow portion 12. Embossed indicia 115 on the second elbow portion indicate the direction in which the locking rod should be moved by the user in order to lock the elbow joint to prevent pivotal movement of the first and second elbow portions about the hinged connection, and also include the word "lock" to indicate the state of the elbow joint when the locking rod is pushed in the direction indicated by the indicia 115.

A hole 132 in the second portion 131 of the locking rod 13 provides means for attachment of a strap (not shown) which assists the user in moving the locking rod from the first configuration into the second configuration.

Figure 6:
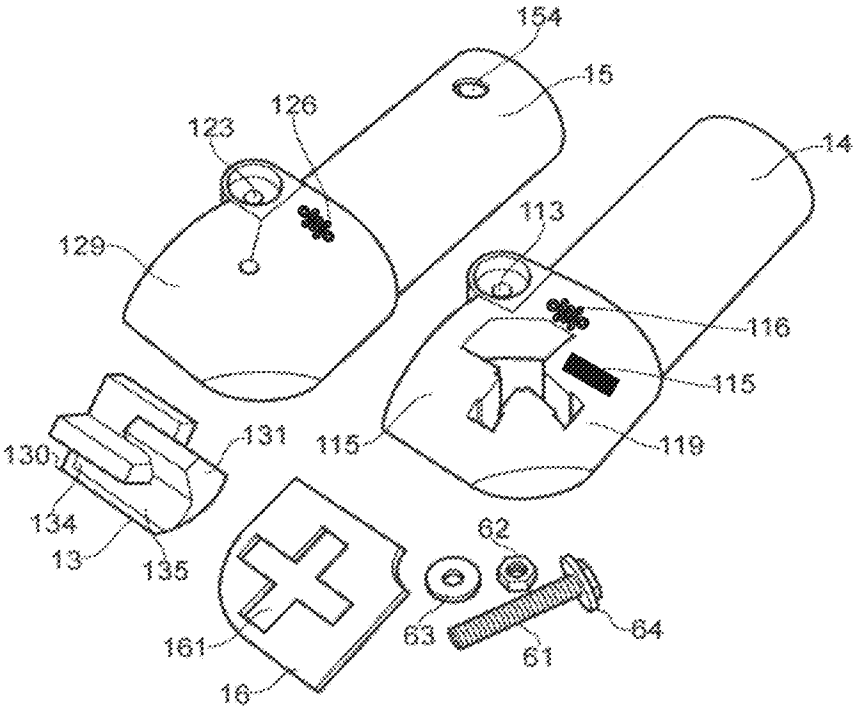
FIG. 6: shows an elbow joint according to one embodiment of the present invention in a disassembled state.

FIG. 6 shows an elbow joint according to the same embodiment as shown in FIGS. 1-5, in a disassembled state, further including a threaded bolt 61, a complimentary threaded nut 62 and washers 63, 64. The bolt 61 passes through bores 113 and 123 to secure the hinged connection between the first and second elbow portions.

Figure 7:
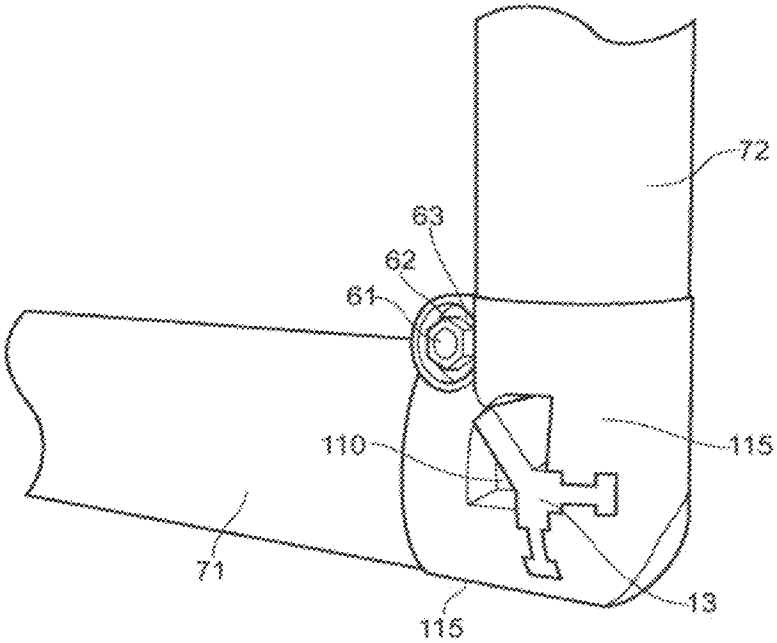
FIG. 7: shows a perspective view of an elbow joint according to one embodiment of the present invention in an assembled state; in the first configuration; and removably connected to first and second goal posts.

FIG. 7 shows an elbow joint according to the same embodiment as shown in FIGS. 1-6, in an assembled state and with the locking rod 13 in the first (locked) configuration. The first goal-post 71 is attached by a friction fit over the first arm 15 and the outer surface of the first goal-post 71 lies flush with the outer surfaces of both corner portions 119 and 129. A second goal-post 72 is attached by a friction fit over the second arm 14 and the outer surface of the second goal-post 72 lies flush with the outer surfaces of corner portions 119 and 129. Furthermore, the outer surfaces of corner portions 119 and 129 also lie flush with one another. The locking rod 13 does not protrude from any surface of the elbow joint. The result is a very neat and self-contained structure which is simple to use and offers superior strength and durability.

Figure 8:
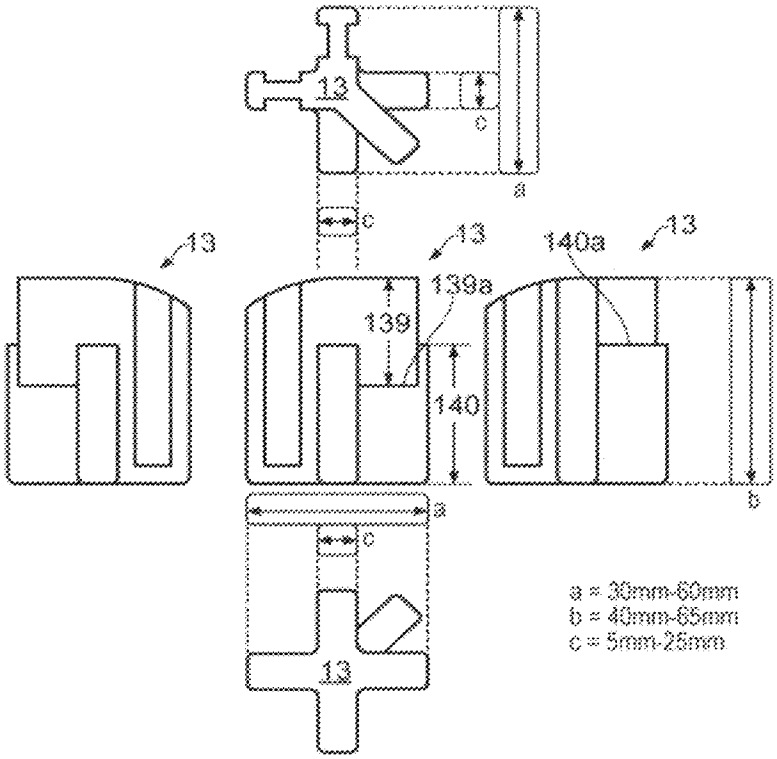
FIG. 8: shows five different plan views of the locking rod of the elbow joint.

FIG. 8 shows the locking rod 13 of the elbow joint in more detail. Five different plan views of the same locking rod are shown. The locking rod has a cross shaped transverse cross section, the cross section comprising four equally spaced arms which of equal length (i.e. the cross section has a swiss-cross cross configuration). The maximum diameter of the cross shaped portions of the locking rod is the straight line distance from the tip of one arm to the tip of the opposite arm. The locking rod shown in FIG. 8 has a maximum diameter "a" in the transverse direction (i.e. perpendicular to its longitudinal axis) which is more than 46 mm in the embodiment shown but may take any value from 30 mm to 60 mm. Each arm of the cross-shaped locking rod has a thickness "c" which is 10.5 mm in the embodiment shown but may take any value, which is no less than 5 mm and no more than 25 mm.

The length of the locking rod along its longitudinal axis "b" is 56.5 mm in the embodiment shown in FIG. 8 but may take any value which is no less than 40 mm and no more than 65 mm.

As shown in the plan views of FIG. 8, the Y-shaped terminal portion 139 extends along half of the length of the longitudinal axis of the locking portion. At one end of the locking portion, the transverse cross section is cross-shaped, and at the other end, the transverse MSS section is Y-shaped. However, the cross-shaped portion extends along more than half of the longitudinal length of the locking portion, such that there is an area of overlap at which the cross section of the locking portion includes both four equally spaced arms (in a swiss cross type configuration) and also a fifth arm corresponding to the "stem" of the Y-shaped terminal portion, the stem being located at a 45 degree angle to adjacent arms of the cross.

Each of the cross-shaped portion 140 and the Y-shaped terminal portion 139 therefore define respective abutment surfaces 140*a*, 139*a* at the ends of the overlapping region, the abutment surfaces configured to stop the locking portion from sliding too far out of or in to the cavities of the elbow joints respectively.

Figure 9:
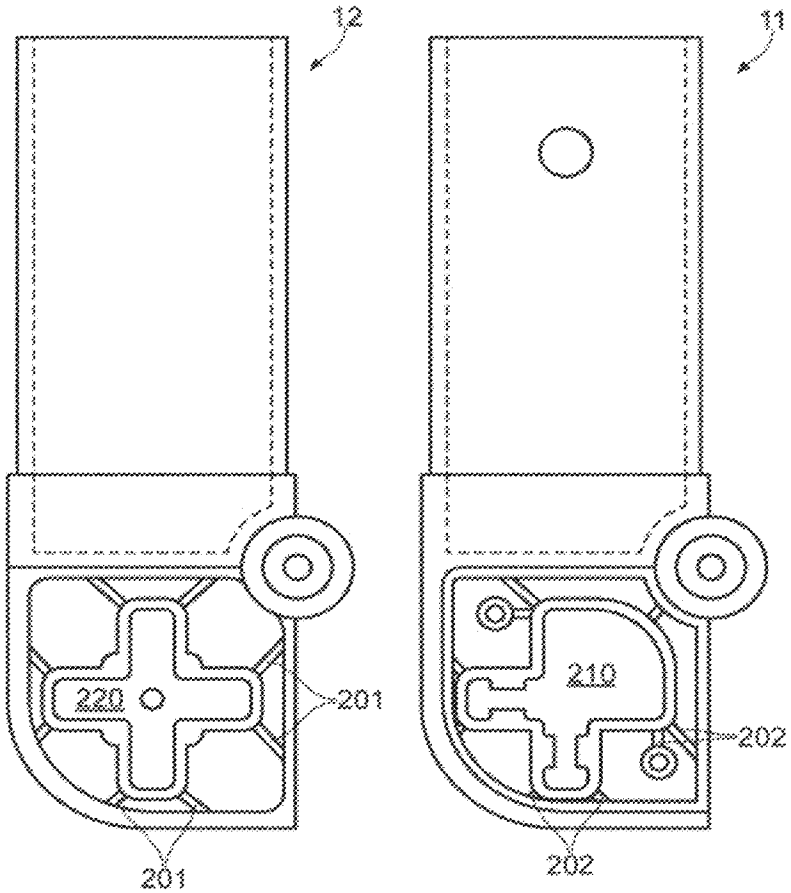
FIG. 9: shows a plan view of first and second elbow portions according to a further embodiment of the present invention.

FIG. 9 shows an example of a first elbow portion 12 and second elbow portion 11 according to a further embodiment of the elbow joint. All other parts of the elbow joint would correspond to the embodiment described above in relation to FIGS. 1 to 8. The embodiment in FIG. 9 differs from that of FIGS. 1 to 8 in that it further comprises an internal strengthening structure.

In FIG. 9, the internal stale e takes the form of a plurality of strengthening ribs 201, 202.

The first elbow portion 12 comprises a plurality of strengthening ribs 202 which extend outwards from the first cavity 220 along a direction perpendicular to the axis along which the locking rod is moveable. The strengthening ribs are located around the entire cavity and are positioned at each apex of the cross-shaped cavity 220.

The second elbow portion 11 comprises a plurality of strengthening ribs 201 which extend outwards from the second cavity 220 along a direction perpendicular to the axis along which the locking rod is moveable. The strengthening ribs 201 are located around the entire cavity and are positioned at each apex of the cross-shaped cavity 220. A strengthening rib is also located extending outwards from the extra cavity area of the second cavity 210 towards the outer edge of the elbow portion.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The embodiments of the invention in which an exclusive property or privilege is claimed are defined as follow:

1. An elbow joint for a foldable goal post assembly, the elbow joint comprising:

a first elbow portion attachable to a first goal post;

a second elbow portion attachable to a second goal post, the second elbow portion being pivotally connectable to the first elbow portion about a hinged connection, the hinged connection having a pivot axis; and a locking rod having a longitudinal length, a central longitudinal axis and a transverse cross section, the transverse cross section being cross-shaped along a first portion of the locking rod and Y-shaped along a second portion of the locking rod, such that the second portion includes a projection extending away from the central longitudinal axis having an end surface and first and second lateral surfaces, the end surface extending between the first and second lateral surfaces, the end surface being distal to the central longitudinal axis;

wherein the first elbow portion defines a first cavity for receiving the first portion of the locking rod and wherein the second elbow portion defines a second cavity for receiving the second portion of the locking rod, the second cavity including an opening for receiving the projection, the first and second cavities being located offset from the pivot axis of the hinged connection; and wherein the elbow joint is configured such that the locking rod is slidably movable in a direction perpendicular to a plane in which the first elbow portion and second elbow portion are able to rotate relative to each other, the locking rod being slidably movable between a first configuration and a second configuration, wherein:

in the first configuration the first portion of the locking rod is located within the first cavity and the second portion of the locking rod is located within the second cavity to lock the elbow joint by preventing pivotal movement of the first and second elbow portions about the pivot axis of the hinged connection, wherein the locking rod is fully located within the first and second cavities such that the locking rod does not protrude from the first and second cavities, and the opening of the second cavity provides access to the first and second lateral surfaces by a user's hand; and in the second configuration the locking rod is pulled out of at least the first cavity to unlock the elbow joint such that the first and second elbow portions are permitted to pivot about the hinged connection.

2. The elbow joint according to claim 1, wherein a width of the locking rod along a direction transverse to an axis along which it is slidably movable is more than or equal to 30 mm.

3. The elbow joint according to claim 1, wherein the locking rod includes a first abutment surface which abuts a projection from an inner wall of the second cavity in the second configuration, to prevent complete removal of the locking rod from the second cavity.

4. The elbow joint according to claim 1, wherein the elbow joint includes an insert which lies between the first and second elbow portions, and the projection of the locking rod, in the first configuration, abuts a portion of the insert to prevent further passage of the locking rod into the first cavity.

5. The elbow joint according to claim 1, wherein the first elbow portion comprises a first stop surface, and the second elbow portion comprises a second stop surface, the first and second stop surfaces being in contact with one another at a terminal position in the pivotal movement of the first and second elbow portions such that pivotal movement beyond the terminal position is prevented.

6. The elbow joint according to claim 5, wherein the first and second elbow portions each comprise a respective arm portion having a respective elongate axis and wherein, at the terminal position, the elongate axes of the first and second arm portions are perpendicular.

7. The elbow joint according to claim 1, wherein the locking rod includes a hole for receiving a strap.

8. The elbow joint according to claim 1, wherein the first elbow portion comprises a first planar surface, and the second elbow portion comprises a second planar surface, the first and second planar surfaces each lying in planes perpendicular to the pivot axis of the hinged connection.

9. The elbow joint according to claim 1, wherein one or more of the first and second elbow portions further comprises an internal strengthening structure.

10. The elbow joint of claim 9, wherein the internal strengthening structure comprises a plurality of strengthening ribs.

11. A foldable goal-post assembly including a first goal post having a first end;

a second goal post, adjacent the first post, having a first end; and the elbow joint of claim 1 connecting the first and second posts at their respective first ends.

12. The foldable goal-post assembly according to claim 11, wherein the first and second goal posts are fixedly attached to the first and second elbow portions respectively.

13. The foldable goal-post assembly according to claim 11, wherein the first goal post is a side post and the second goal post is a cross-bar.

* * * * *